US005821968A

United States Patent [19]

Ohyama et al.

[11] Patent Number: 5,821,968

[45] Date of Patent: Oct. 13, 1998

[54] INK JET RECORDING APPARATUS AND A PROCESS OF INK JET RECORDING

[75] Inventors: Kazuo Ohyama, Mitaka; Hiroshi Sugiyama; Haruo Uchida, both of Yokohama, all of Japan

[73] Assignee: Canon Kabushiki Kaisha, Tokyo, Japan

[21] Appl. No.: 819,989

[22] Filed: Mar. 18, 1997

Related U.S. Application Data

[63] Continuation of Ser. No. 281,553, Jul. 28, 1994, abandoned.

[30] Foreign Application Priority Data

| | | | |
|---|---|---|---|
| Jul. 28, 1993 | [JP] | Japan | 5-186453 |
| Sep. 6, 1993 | [JP] | Japan | 5-221258 |
| Sep. 17, 1993 | [JP] | Japan | 5-231613 |

[51] Int. Cl.[6] ..... B41J 2/01; B41J 11/06

[52] U.S. Cl. ..... 347/104; 271/193

[58] Field of Search ..... 347/104; 271/193; 355/272–274

[56] References Cited

U.S. PATENT DOCUMENTS

| | | | |
|---|---|---|---|
| 4,864,461 | 9/1989 | Kasahara | 347/104 |
| 5,216,442 | 6/1993 | Parks et al. | 347/104 |
| 5,245,364 | 9/1993 | Uchida et al. . | |
| 5,270,738 | 12/1993 | Takahashi et al. . | |
| 5,531,436 | 7/1996 | Ohyama et al. | 347/101 |

FOREIGN PATENT DOCUMENTS

| | | |
|---|---|---|
| 0409596 | 1/1991 | European Pat. Off. . |
| 2639109 | 5/1990 | France . |
| 62-265527 | 11/1987 | Japan . |
| 3143697 | 6/1991 | Japan . |
| 4361073 | 12/1992 | Japan . |
| 5147762 | 6/1993 | Japan . |

OTHER PUBLICATIONS

Naramore, "Constant Velocity Copy Sheet Transport for Ink Jet Printing" Xerox Disclosure Journal, vol. 8, No. 1, pp. 19–20, Jan./Feb. 1983.

*Primary Examiner*—Huan H. Tran
*Attorney, Agent, or Firm*—Fitzpatrick, Cella, Harper & Scinto

[57] ABSTRACT

An ink jet recording apparatus has an ink recording region and an electrostatic attraction device. The ink recording region is located at a position spaced from an ink jet recording head. The electrostatic attraction is arranged at an opposite side to a surface of a recording medium to be recorded, in the ink recording region. The has a plurality of first regions and second regions which are alternately distributed. The first regions electrostatically attract the recording medium in the ink recording region relatively strongly and the second regions attract the recording medium relatively weakly. The electrostatic attraction serves to minimize the effects of cockling and that assures stable, high quality recording.

21 Claims, 17 Drawing Sheets

INK JET RECORDING APPARATUS AND A PROCESS OF INK JET RECORDING

This application is a continuation of application Ser. No. 08/281,553 filed Jul. 28, 1994, now abandoned.

BACKGROUND OF THE INVENTION

FIELD OF THE INVENTION

The present invention relates to an ink jet recording apparatus having a mechanism which attracts a recording medium by an electrostatic attraction means and more particularly to an ink jet recording apparatus that minimizes influences of cockling during ink recording. The present invention also relates to a process of ink jet recording using the apparatus above.

Here, the word recording also means printing, which includes the action of applying ink to any kind of ink holding member, such as cloth, threads, paper, plastic sheets and flexible sheet materials, and also includes various kinds of information processing apparatuses or printers as their output devices. The invention is applicable to these apparatuses.

Generally, in ink jet recording apparatuses, a gap must be kept as a constant interval defined between the surface of a recording medium and an ink jet recording head to ensure stable recording. This requires a means to hold the recording medium attracted on a feeding system. Among examples of this means is the specification of U.S. Pat. No. 5,245,364, which discloses a means for injecting electric charges, from a high-voltage source through a charger and rollers, onto an insulation layer, the top layer of a two-layer transport belt consisting of an insulating layer and an electroconductive layer, thereby uniformly and strongly attracting the entire surface of the recording medium when the medium is fed or transported.

The specification discloses that the conventional attraction means have a drawback in that the attraction force of the transport belt is weakened because electric charges imparted to the transport belt are discharged in air while the transport belt moves from a position where it is given an attraction force from the charged rollers to a position where ink is delivered. The specification further discloses an invention which enables attraction uniform and strong enough to complement the reduction in attraction force caused by the discharge.

The recording ink generally uses water as a main solvent. When an image to be recorded has high density, a large amount of water is applied to and driven into the recording medium, which in turn swells and increases in size causing the printed portion to wave like a corrugated tin plate, a phenomenon generally known as cockling. There is no apparatus that offers a fundamental solution to this phenomenon.

The inventors of the present invention have found that the more they try to fundamentally prevent the occurrence of such cockling, the greater local concentration of cockling tends to occur and that although the recording medium as a whole is fed evenly, the cockling of a part of the recording medium grows abnormally to such an extent that the cockled portion of the recording medium rubs the ink jet recording head.

Our study of this problem found that there is a limitation to the conventional technical idea which requires the recording medium to be held perfectly attracted to the transport belt and uniformly fed. Rather than on this conventional philosophy, the present invention bases itself on a novel idea that allows the occurrence of cockling but restricts the height of the cockling to such a degree as will not affect printing. To describe in more detail, because the conventional feeding method utilizing a uniform strong adhesion by produces a uniform attraction force in the direction of width of the recording medium, swells of the recording medium cannot be absorbed or eliminated, resulting in a cockling phenomenon whereby the recording medium is floated up to more than 2 mm at one or more unspecified locations, causing the cockled recording medium to contact the recording head, which in turn disturbs the preferred image to be printed and clogs delivery nozzles of the recording head.

SUMMARY OF THE INVENTION

An object of the present invention is to provide an ink jet recording apparatus which solves the above-mentioned technical problem and is capable of performing stable recording by minimizing such adverse phenomena as cockling.

Another object of the present invention is to provide an ink jet recording apparatus which can reliably hold the recording medium at the recording position until the end of the sheet feeding process regardless of whether the recording medium is swelled with ink, allowing recording that leaves little blank on the recording medium and assuring high-quality recording.

According to an aspect of the present invention, one of the forgoing objects can be achieved by providing an ink jet recording apparatus using an ink jet recording head, having an ink recording region being located at a position spaced from the ink jet recording head, the region at which a recording is performed by the ink jet recording head; and an electrostatic attraction means being arranged at an opposite side to a surface of the recording medium to be recorded, in the ink recording region, the electrostatic attraction means including a plurality of first and second regions, the first and second regions being alternately distributed, the first regions electrostatically attracting the recording medium in the ink recording region relatively strongly, the second regions attracting the recording medium relatively weakly.

Here, the first regions may be where paired comb-shaped electrodes are provided and the second regions may correspond to intervals between the paired comb-shaped electrodes.

The intervals between the paired electrodes may be filled with a dielectric.

The electrostatic attraction means may have a transport belt for transporting the recording medium spaced from the ink jet recording head, the transport belt being disposed over the first and second regions.

Here, the electrodes of the electrostatic attraction means may be so arranged that the edges of the recording medium along the direction in which the transport belt transports the recording medium move over the electrodes.

The apparatus further may have an ink tank storing ink to be supplied to the ink jet recording head, the ink tank and the ink jet recording head form a recording head cartridge, the recording head cartridge being removably mounted on a carriage which is movable in a direction perpendicular to the direction in which the transport belt transports the recording medium.

In the apparatus, if X stands for the number of the electrodes and L stands for the length of the recording medium to be attracted as measured in the direction of electrode arrangement, a minimum distance $\alpha$ between the recording medium and the ink jet recording head for a height Z of deformation of the recording medium caused by ink recording may be determined from the following relationship:

$$\frac{1}{80}\ \frac{L}{(Y-\alpha)} \leqq X \leqq \frac{1}{20}\ \frac{L}{(Y-\alpha)} \quad (1)$$

where Z<Y; Y is the distance between the recording medium and the recording head; and L represents an absolute value of the length in millimeters.

In the apparatus, if one of the paired electrodes is grounded and produces no attraction force, and if X stands for the number of the electrodes and L stands for the length of the recording medium to be attracted as measured in the direction of electrode arrangement, a minimum distance $\alpha$ between the recording medium and the recording head for a height Z of deformation of the recording medium caused by ink recording may be determined from the following relationships:

$$\frac{1}{40}\ \frac{L}{(Y-\alpha)} \leqq X \leqq \frac{1}{10}\ \frac{L}{(Y-\alpha)} \quad (2)$$

where Z<Y; Y is the distance between the recording medium and the recording head; and L represents an absolute value of the length in millimeters.

The apparatus further may have a recording medium retaining means pressing the recording medium against the transport belt, the recording medium retaining means provided at least near the upstream side of the ink recording region in a recording medium transport path defined by the transport belt.

Here, the recording medium retaining means may be further provided near the downstream side of the recording region.

At least the contacting portion of the recording medium retaining means may be formed of an electroconductive material.

According to another aspect of the present invention, another object of the present invention can be achieved by providing a process of ink jet recording, having the steps of preparing an ink jet recording apparatus using an ink jet recording head; the apparatus including an ink recording region being located at a position spaced from the ink jet recording head, the region at which a recording is performed by the ink jet recording head; and an electrostatic attraction means being arranged at an opposite side to a surface of the recording medium to be recorded, in the ink recording region, the electrostatic attraction means including a plurality of first and second regions, the first and second regions being alternately distributed, the first regions electrostatically attracting the recording medium in the ink recording region relatively strongly, the second regions attracting the recording medium relatively weakly; and of performing ink recording by using the electrostatic attraction means to distribute concentration of cockling which is formed in the recording medium by the ink recording.

Further, another object of the present invention can be achieved by providing a process of ink jet recording, having the steps of preparing a liquid ink recording apparatus having a plurality of attraction regions for electrostatically attracting partly a recording medium; and of performing the plurality of attraction regions of said apparatus to distribute a concentration of cockling which is formed on the recording medium by the liquid ink recording.

With the present invention, an attraction force is generated on the electrode plates and almost none between the electrodes. Because the electrodes extend in the same direction as the direction of feed of the recording medium, there is generated a distribution of strong and weak attraction forces in the width direction of the recording medium. Therefore, the swell or expansion of the medium, which occurs especially when the image to be recorded is dense, can be absorbed in spaces between electrodes where almost no attraction force is generated. That is, because the swell is divided into two or more cockles at particular location, it is possible to make each of the cockles smaller and therefore prevent contact between the recording medium and the recording head.

Further, because the attraction force generation means utilizes an electrostatic force, noise is not produced.

Another feature of the present invention is that the attraction force generated at the back of the recording region of the recording medium and which acts along the transport or feeding means, holds the recording medium firmly to the transport means while it is moved and recorded, making it possible to set the recording surface of the recording medium sufficiently close to the ink ejection nozzle of the recording head. This in turn allows the blank margins at the longitudinal ends of the recording medium with respect to the direction of feed to be reduced significantly. If we let the lateral length of the recording medium as measured in the direction of electrode arrangement be L (mm) and the number of electrodes be X, a minimum distance $\alpha$ between the recording medium and the recording head required when the recording medium has a deformation with a height Z caused by recording is determined from the following relationship $$\frac{1}{80}\ \frac{L}{(Y-\alpha)} \leqq X \leqq \frac{1}{20}\ \frac{L}{(Y-\alpha)} \quad (3)$$

(where Z<Y; Y is the distance between the recording medium and the recording head; and L represents an absolute value of the length in millimeters). With this relationship satisfied, it is possible to minimize the swell or cockling caused when ink is driven into and absorbed by the recording medium.

Further, in addition to the transport belt to feed the recording medium and the attraction force generating means to hold the recording medium to the transport belt, the present invention provides, as necessary, a recording medium retaining means that presses the recording member against a transport path near the recording region. With this construction, because the recording medium can be held to the transport belt as it is carried by the transport belt and recorded the recording medium is allowed to come close to the nozzle of the recording head in the recording region while maintaining a specified gap between them. This in turn permits significant reduction of the blank margin on the recording medium.

By holding the recording medium to the transport belt by the attraction force generating means and the recording medium retaining means, the cockling caused by the ink being driven into and absorbed by the recording medium can be minimized.

Still another feature of the present invention is that the attraction force generating means used to hold the recording medium to the transport belt utilizes an electrostatic force and that the recording medium retaining means is formed of a conductive member. In this construction, by grounding he recording medium retaining means or by applying to it an electric charge of a polarity reverse to that applied to the attraction force generating means, it is possible to remove the electric charge (surface potential) of the same polarity as that applied to the attraction force generating means from the recording surface of the recording medium through the recording medium retaining means. This prevents the electric charge (surface potential) produced on the recording surface from adversely affecting the recording, which is therefore stabilized.

Furthermore, when variations in environment (temperature and humidity) have caused waving and curling at the ends of the recording medium, the combined working of the recording medium retaining means and the attraction force generating means ensures reliable holding of the recording medium to the transport belt and therefore stable recording.

The above and other objects, effects, features and advantages of the present invention will become more apparent from the following description of embodiments thereof taken in conjunction with the accompanying drawings.

BRIEF DESCRIPTION OF THE DRAWINGS

FIG. 6 is a schematic perspective view showing a fourth embodiment of the ink jet recording apparatus of the present invention;

DETAILED DESCRIPTION OF EMBODIMENTS

By referring to the accompanying drawings, embodiments of the present invention will be described in detail.

(Embodiment 1)

Figure 1:
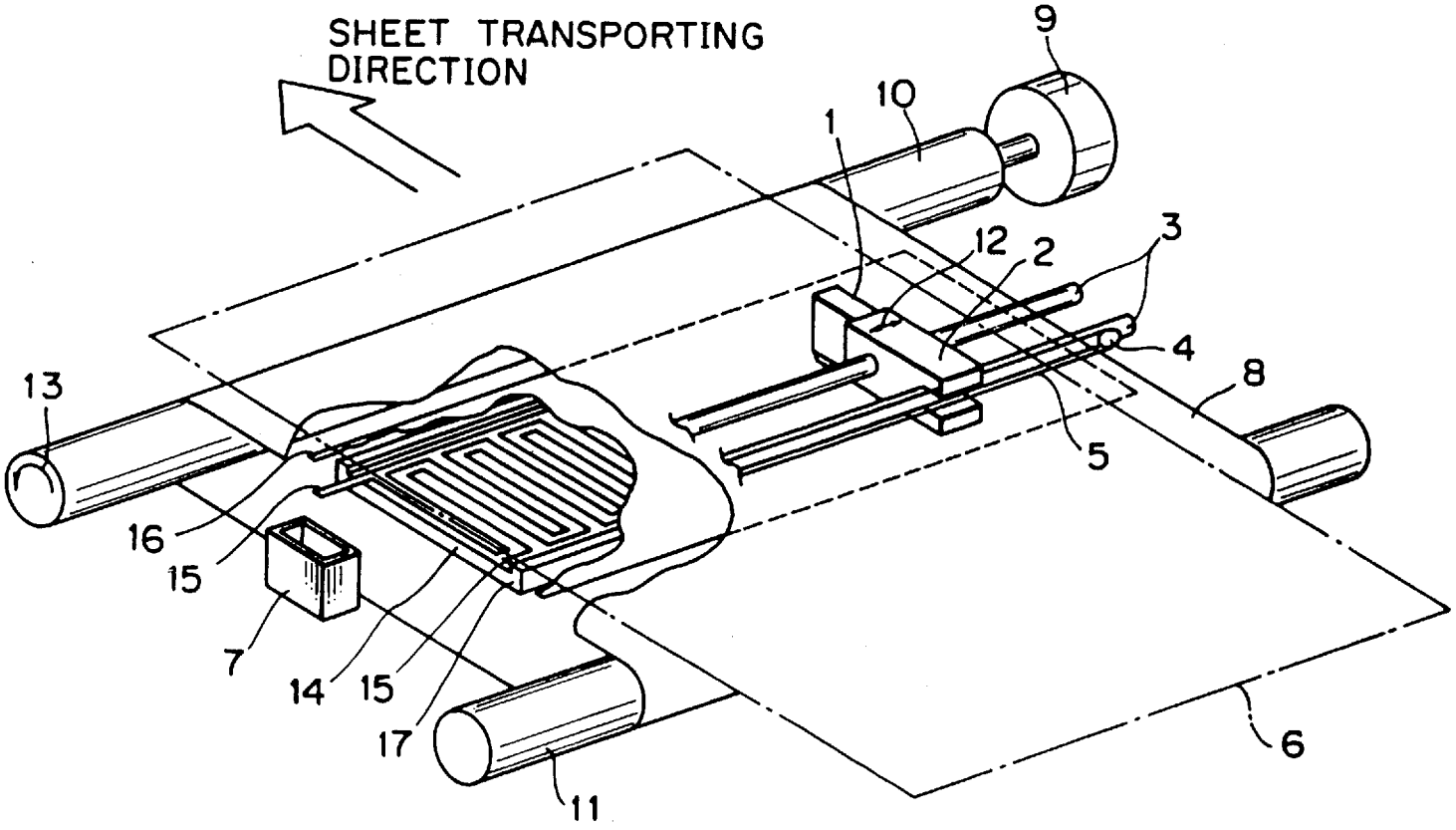
FIG. 1 is a schematic perspective view showing a first embodiment of the ink jet recording apparatus according to the present invention.

FIG. 1 is a partly cutaway perspective view showing a first embodiment of the ink jet recording apparatus of the present invention. In FIG. 1, reference numeral 1 designates a cartridge including an ink jet recording head (hereinafter referred to simply as a recording head) that performs recording by delivering ink and an integral ink tank. Reference numeral 1 also refers to the recording head itself. Denoted 2 is a carriage that supports the recording head 1 as it moves. Designated 3 are guide rails that guide and support the carriage 2. Reference number 4 represents a pulley directly coupled to a motor (not shown) that drives the carriage 2. Denoted 5 is a wire wound around the pulley 4 and a follower pulley (not shown); 6 a recording medium such as paper (or a recording sheet); 7 a cap member to protect the nozzles of the recording head 1 from being dried as when it is standing by; 8 an endless transport belt about 0.15 mm thick formed of a synthetic resin such as polyethylene, polycarbonate and polyester and which attracts the recording medium 6 as it moves; 9 a motor that drives the transport belt 8 through a drive roller 10; and 11 a follower roller driven by the drive roller 10.

The direction of movement of the carriage 2 is indicated by an arrow 12 and the direction of rotation of the drive roller 10 is represented by an arrow 13.

An attraction force generating means 14 is arranged to face the recording head 1 with the transport belt 8 disposed therebetween. A pair of comb-shaped electrodes 15 is supplied with a specified voltage to generate an attraction force and is connected to a high-voltage source (not shown) that produces a specified high voltage. These electrodes 15 and the power source together constitute the attraction force generating means 14.

A protective film 16 protects the transport belt 8 as it slides over the comb-shaped electrode 15. A platen plate 17 supports the comb-shaped electrodes 15.

In the apparatus of the above construction, the recording is performed in the following way. The recording head 1 parts from the cap member 7 and is moved for scanning in the direction of the recording medium 6 along with the carriage 2 by the force transmitted from the motor not shown through the pulley 4 and the wire 5 wound around the follower pulley. After it has moved a predetermined distance, the recording head 1 is reversed in the direction of cap member 7. That is, the recording head 1 moves forward and returns in the direction of arrow 12 and delivers ink droplets at specified position on the recording medium 6 to make recording.

The recording medium 6 is attracted to the plane portion of the transport belt 8 by the electrostatic attraction force generated by the attraction force generating means 14 and is fed a specified distance in the direction of arrow 13 by the motor 9 each time the recording head 1 has finished one complete scan. By repeating this series of operations, recording can be performed. At this point, because the left and right end portions of the recording medium 6 as seen from the direction of feed easily float from the transport belt 8, the comb-shaped electrodes 15 are so arranged that the left and right end portions of several kinds of recording medium that are chosen beforehand for use are located above electrodes that produce strong attraction force.

Figure 2:
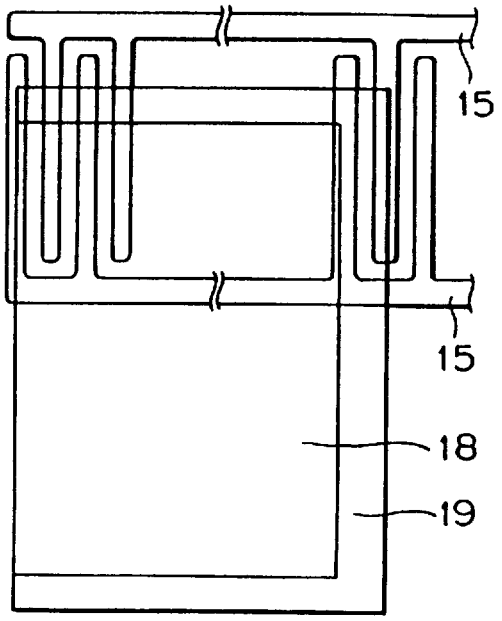
FIG. 2 is a schematic plan view showing a recording medium which is arranged, with one side taken as a reference, on a comb-shaped electrode that forms a part of an attraction force generation means in the embodiment of FIG. 1.
Figure 3:
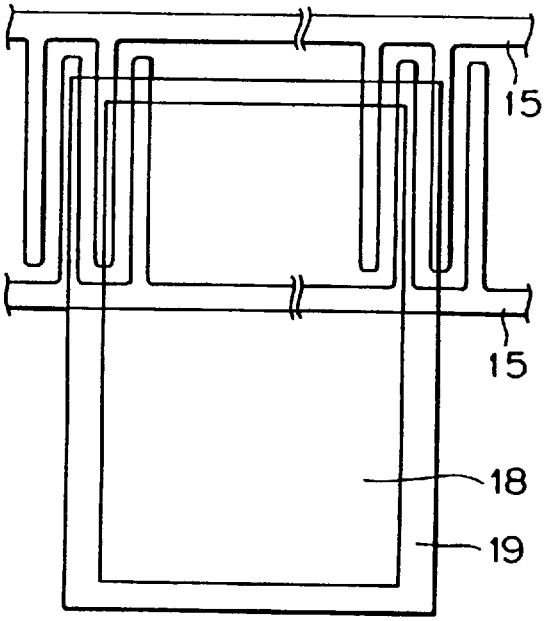
FIG. 3 is a schematic plan view showing a recording medium which is arranged centered on the comb-shaped electrode that forms a part of the attraction force generation means in the embodiment of FIG. 1.

FIG. 2 is a plan view showing an example arrangement of the comb-shaped electrodes 15 of this embodiment, in which the recording medium 18 of B5 size set up by JIS or Japanese Industrial Standards and the recording medium 19 of A4 size have their one side taken as a transport reference. FIG. 3 is a plan view showing another example arrangement of the comb-shaped electrodes 15 of this embodiment, in which the recording mediums 18 and 19 of B5 size and A4 size respectively have their center taken as a transport reference. By arranging the comb-shaped electrodes 15 as shown in FIG. 2 or 3, it is possible to prevent the left and right ends of the recording medium 6 from floating from the transport belt 8 and thereby prevent their contact with the recording head 1.

In the recording operation described above, when the image to be recorded has high density, the recording medium 6 shown in FIG. 1 has driven therein a large amount of recording ink, which uses water as a main solvent, and thus swells and becomes large in size. At this point, although the recording medium 6 is held to the transport belt 8, the swell of the medium cannot be contained, forming cockles which separate from the belt 8. Because the comb-shaped electrodes 15 extend along the feed direction of the recording medium 6 being moved by the transport belt 8, there is generated a distribution of strong and weak intensities of attraction force in the width direction of the recording medium 6. Therefore, the swell or expansion of the medium 6 can be absorbed by intervals between electrodes where almost no attraction force is generated. That is, because the swell is divided into two or more cockles at particular locations, it is possible to make each cockle smaller and therefore prevent contact between the recording medium 6 and the recording head 1.

Further, since the comb-shaped electrodes 15 extend in the direction that the recording medium 6 moves, the portions of the medium 6 which were being attracted will not shift to the areas between electrodes where no attraction force is generated when the recording head 1 enters the next scanning after the transport belt 8 has moved. Therefore, cockling can be minimized throughout the single recording medium. Furthermore, since the comb-shaped electrodes 15 are arranged below and close to the recording head 1, it is possible to suppress cockling at least in the area recordable by the recording head 1.

(Embodiment 2)

Figure 4A:
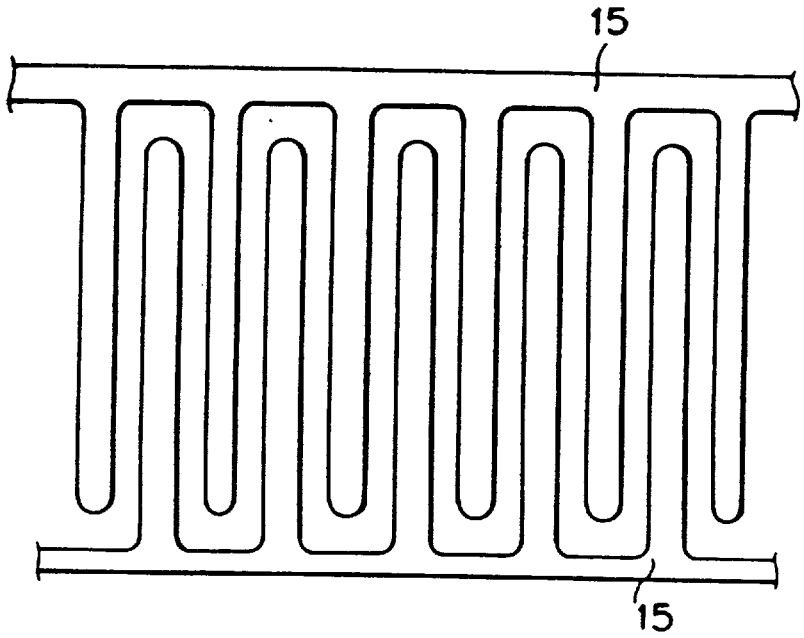
FIG. 4A is a schematic plan view showing a comb-shaped electrode that forms a part of an attraction force generation means in a second embodiment of the ink jet recording apparatus of the present invention.

FIG. 4A is a schematic plan view of comb-shaped electrodes that form a part of an attraction force generating means in the second embodiment of the ink jet recording apparatus of the present invention.

In this embodiment, the edges of the comb-shaped electrodes 15 are all rounded to allow the intervals between electrodes to be reduced and therefore the number of teeth of the comb-shaped electrodes to be increased.

Other aspects of configuration and working are the same as the preceding embodiment.

Figure 4B:
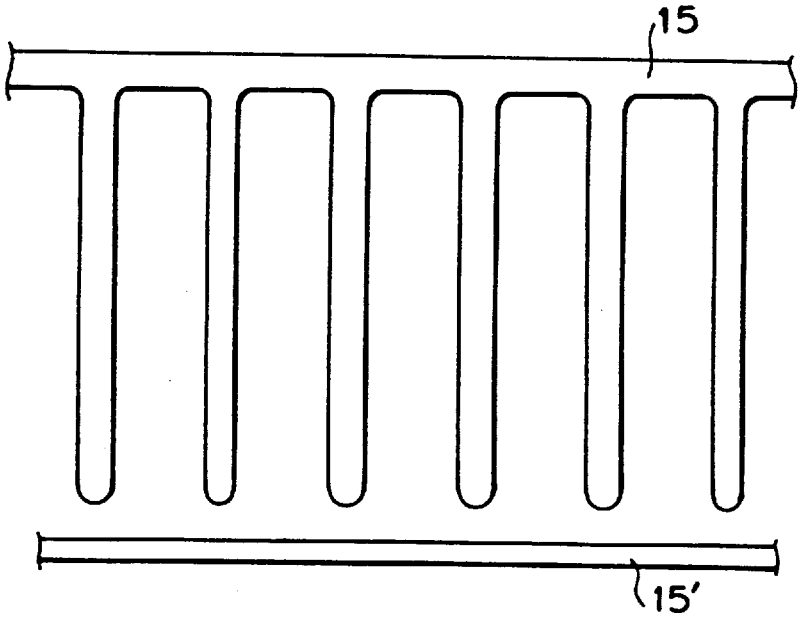
FIG. 4B is a schematic plan view showing a variation of the comb-shaped electrode shown in FIG. 4A.

FIG. 4B is a schematic plan view showing a variation of the comb-shaped electrodes shown in FIG. 4A. While the embodiment of FIG. 4A has a pair of comb-shaped electrodes 15 arranged facing each other, it is also possible to have one of the pair formed as a comb-shaped electrode 15 and the other as a bar electrode 15'. In this case, an electrostatic attractive force is generated between the ends of teeth of the comb-shaped electrode 15 and the bar electrode 15'.

(Embodiment 3)

Figure 5:
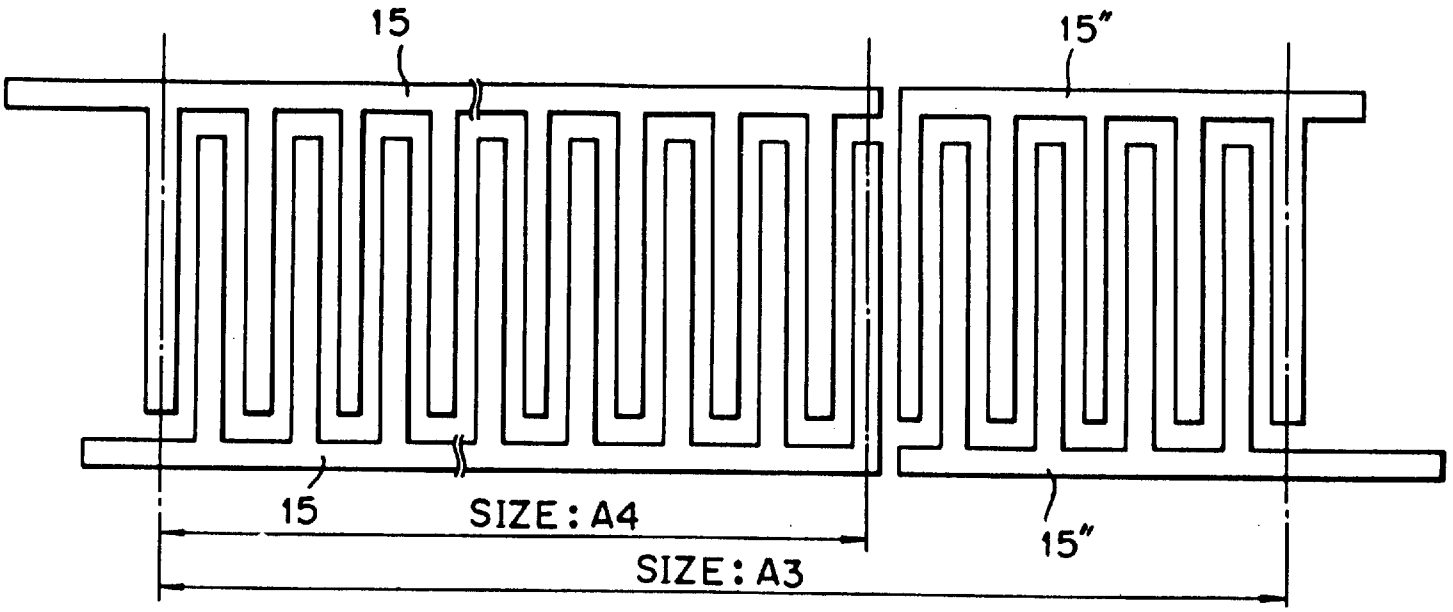

FIG. 5 is a schematic plan view of comb-shaped electrodes that form a part of an attraction force generating means in the third embodiment of the ink jet recording apparatus of the present invention. In addition to the pair of comb-shaped electrodes 15 of the attraction force generating means of FIG. 1, this embodiment includes another pair of comb-shaped electrodes 15" arranged parallel to the direction of movement of the recording head 1.

When the recording medium is A4 size or smaller, the commonly used size range, only the first pair of the comb-shaped electrodes 15 are used. Only when the recording medium is greater than A4 size, is another pair of comb-shaped electrodes 15" used in addition to the first pair of comb-shaped electrodes 15. In this way the electrodes are selected according to the size of the recording medium to reduce the power consumption.

Other aspects of configuration and operation are the same as those of the first embodiment.

While in this embodiment the reference position for feed is set at one end of the first pair of comb-shaped electrodes 15, it is possible to take the center of the whole electrodes as the reference of feed. In other words, although this embodiment has the second pair of comb-shaped electrodes 15" arranged at the other end of the first pair of comb-shaped electrodes 15, it is possible to provide two second pairs of comb-shaped electrodes 15", one at each end of the first pair of the comb-shaped electrodes 15, setting the reference of feed at the center of the electrodes.

(Embodiment 4)

Figure 6:
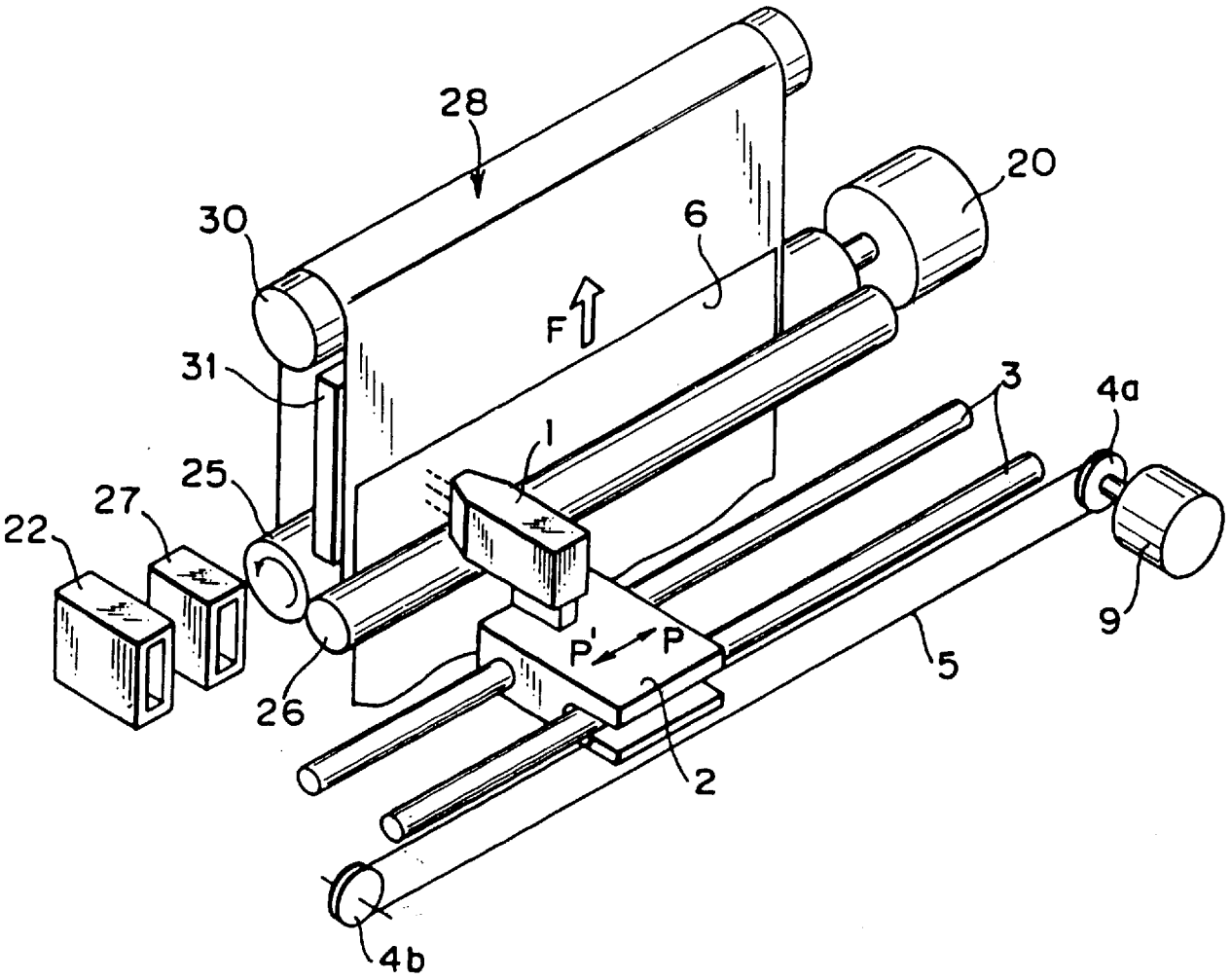
FIG. 6 is a schematic plan view showing a comb-shaped electrode that forms a part of an attraction force generation means in a third embodiment of the ink jet recording apparatus of the present invention.

FIG. 6 is a schematic perspective view showing the fourth embodiment of the ink jet recording apparatus of the present invention. Components having the same construction as those used in the first embodiment of FIG. 1 are given like reference numerals and their explanations are omitted.

In FIG. 6, reference number 4*a* represents a drive pulley directly coupled to a drive motor 9; and 4*b* a follower pulley. A wire 5 is wound around the drive pulley 4*a* and the follower pulley 4*b* to move a carriage 2. Denoted 20 is a sheet feeding motor to feed the recording sheet 6; 22 a cap member to protect the nozzles of the recording head 1 from being dried as when the recording head 1 is standing by; 25 a feed roller to feed the recording sheet 6; 26 a press roller to press the recording sheet 6 against the feed roller 25 by an urging means not shown; and 27 a nozzle cleaning ink receiver case for accommodating ink jetted out from nozzles for the cleaning purpose, not for recording.

The carriage 2 moves in the direction P and P' at predetermined timing and, in synchronism with the scan motion of the carriage, the recording head 1 jets ink for recording.

The recording is done as follows. The recording head 1 whose nozzles are protected by the cap member 22 is released from the cap member 22 and the force of the motor 9 is transmitted through the wire 5 to the carriage 2. The recording head 1 that moves along with the carriage 2 for scanning ejects ink droplets against the recording sheet 6. The recording sheet 6 is fed in the direction of arrow F a specified length by the sheet feeding motor 20 and the feed roller 25 each time the recording head 1 finishes one complete scan. With this series of operations repeated, recording can be made continuously on the surface of the recording sheet.

A sheet holding member 28 is formed of such a synthetic resin as polyethylene and polycarbonate about 0.1–0.2 mm thick, and is stretched between rollers 25 and 30 in the form of an endless belt to hold the recording sheet 6 attracted thereto and move it. An attraction force generating means 31 is fixed at a position facing the recording head 1 and is connected to a high-voltage source (not shown) that produces a specified high voltage. The attraction force generating means 31 is applied a specified voltage to generate an attraction force at a portion of the sheet holding member 28 that corresponds to the area where recording is done by the recording head 1. The roller 25 is driven by the sheet feeding motor 20.

In the ink jet recording apparatus of the above construction, during the recording operation the recording sheet 6 is pressed against the roller 25 by the press roller 26 through the sheet holding member 28. While it is kept attracted to the sheet holding member 28 by the attraction force that the attraction force generating means 31 has imparted to the sheet holding member 28, the recording sheet 6 is held at a position facing the ink nozzles of the recording head 1 as shown in FIG. 1.

Then, with the recording sheet 6 held in this state, ink is jetted out from the nozzles against the recording sheet 6 as the recording head 1 is moved by the carriage 2 in the direction of arrow P. Each time the recording for one complete scan is finished, the rollers 25, 20 and the sheet holding member 28 together feed the recording sheet in the direction of arrow F.

Because the sheet holding member 28 can attract the portion of the recording sheet 6 facing the recording head 1 when it feeds the sheet, no part of the recording sheet 6 protrudes toward the recording head 1 even when the front and rear portions of the recording sheet 6 are being recorded, allowing the nozzles of the recording head 1 and the attracted end of the recording sheet 6 to come close to each other, thereby minimizing the blank margin on the recording sheet 6.

Figure 7:
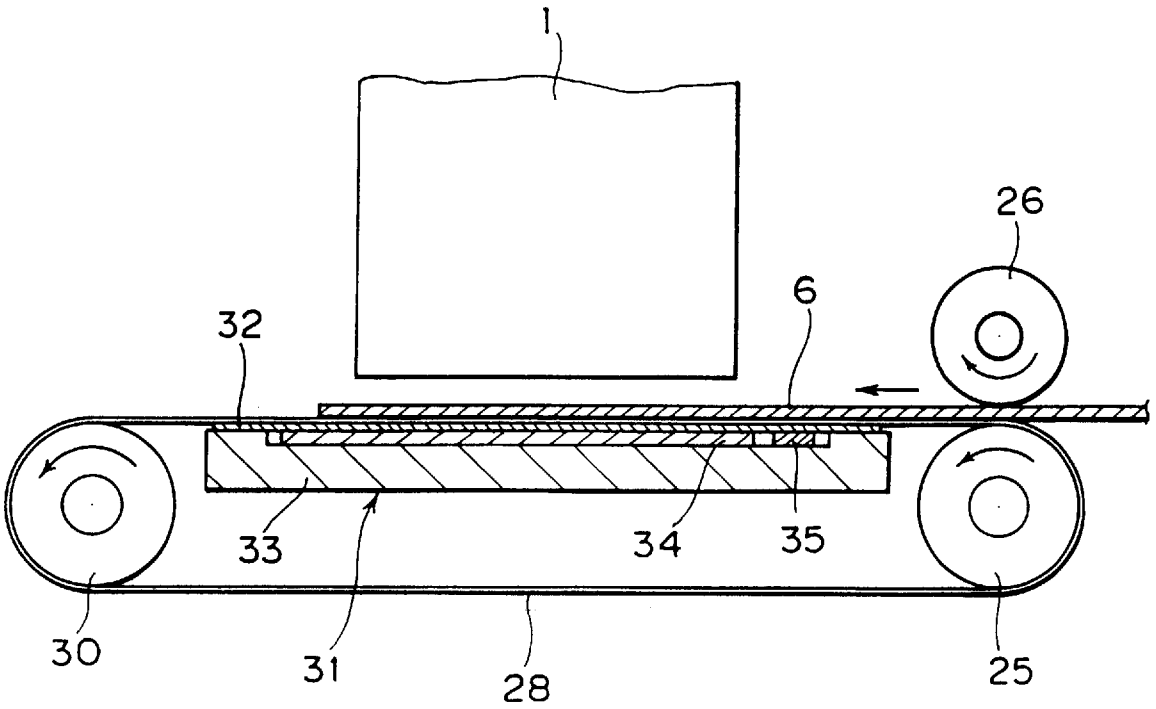
FIG. 7 is a schematic cross sectional view showing the recording apparatus shown in FIG. 6.
Figure 8:
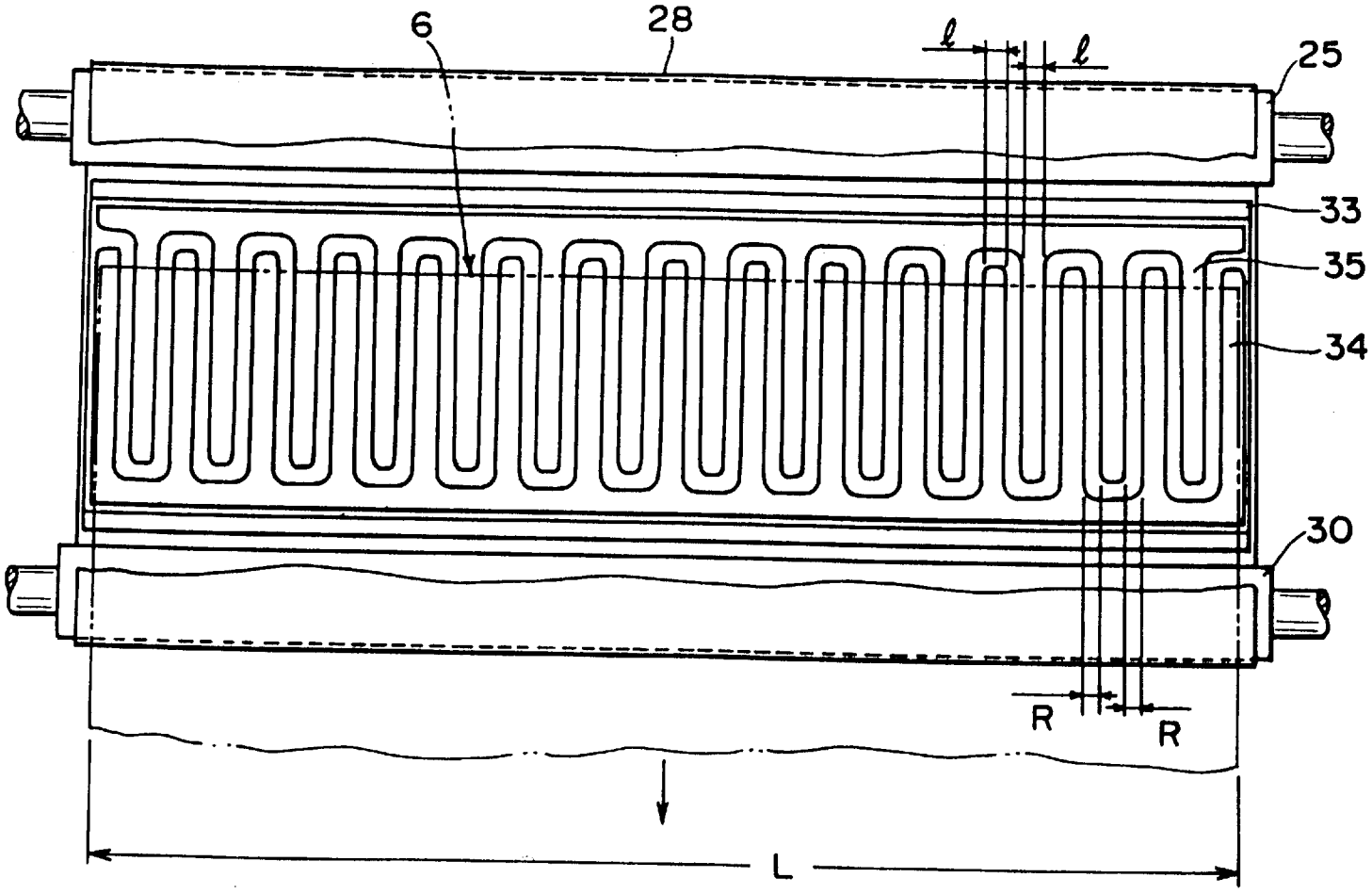
FIG. 8 is a schematic plan view of the recording apparatus shown of FIG. 6.

Next, the construction of the attraction force generating means 31 is described in detail by referring to FIG. 7 and 8.

As shown in FIG. 7, on the underside of the sheet holding member 28 corresponding to the recording area there is provided a protection film 32 in contact with the sheet holding member 28.

The protection film 32, like the sheet holding member 28, is formed of synthetic resin such as polyethylene and polycarbonate about 0.1–0.2 mm thick. The protection film 32 is fixed, as by bonding, to an electrode mount 33. The underside of the protection film 32 is provided with electrode plates 34 and 35 formed of a conductive metal and kept in contact with the protection film 32. These electrode plates 34 and 35 are secured to the electrode mount 33 as by bonding.

The electrode plates 34 and 35, as shown in FIG. 8, are both formed like a comb and arranged so that the recessed portions of one electrode plate accommodate the protruding portions of the other electrode plate with specified intervals provided therebetween. One electrode plate 34 is supplied with a positive or negative voltage and the other electrode plate 35 is supplied with a voltage of reverse polarity or grounded.

Symbol R represents intervals between the comb teeth of the electrode plates 34 and 35 and symbol L represents the length of the recording sheet 6 in the direction of electrode arrangement (in FIG. 8, sheet width in millimeters).

Next, by referring to FIG. 9, a cockling (or sheet waving) phenomenon for the recording sheet 6, which is attracted to the electrode plates 34 and 35 through the protective film 32 and the sheet holding member 28, will be described.

As the ink is jetted out in large amounts toward the recording sheet 6, the recording sheet 6 absorbs ink and tends to expand in a direction in which its size is going to increase. In this embodiment, however, because the recording sheet 6 is held to the sheet holding member 28 by the attraction force generated in the electrode plates 34 and 35, the portion of the recording sheet 6 about to swell is allowed to expand and float only at the areas between the electrodes that have no attraction force and are represented by symbol R. These bulging portions rise toward the head 1 forming wavelike cockles as shown in FIG. 9.

Figure 9:
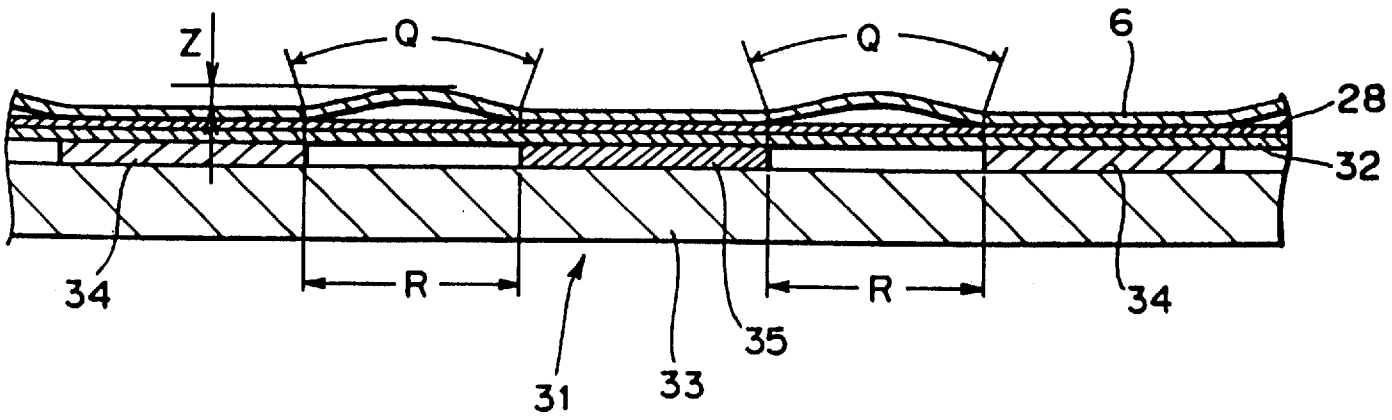
FIG. 9 is a schematic cross sectional view used to explain a cockling phenomenon that can occur with the recording medium in the recording apparatus of FIG. 6.

Symbol Z in FIG. 9 represents the amount of bulging of the recording sheet 6 (i.e. amount of cockling) and symbol Q represents the length along the surface of a bulge of the recording sheet 6 formed in the intervals R between the electrodes.

If we let a stand for the swelling factor when ink is driven into the recording sheet 6, the elongation of the recording sheet width L (mm) is represented by La.

Because the amount of elongation of the recording sheet 6 that is absorbed by a single cockle is expressed by (Q−R), the number of cockles Mx required to keep the amount of cockling at Z is given by the following equation:

$$\frac{La}{Q-R} = Mx \tag{4}$$

It is experimentally known that the maximum elongation of the recording sheet during the high density recording is about 1% in terms of swelling factor. To minimize the gap between the nozzle of the ink recording head 1 and the recording sheet 6 and improve the ink droplet landing accuracy, it is desired that the amount of cockling Z be suppressed to about 0.2 mm. The interval R between the electrodes needs to be 2 mm or more to prevent discharge between them (when the voltage applied to the electrode is 0.5–3 kV). Thus, the condition that keeps the amount of cockling below 0.2 mm and the interval between electrodes at 2 mm when the swelling factor is 1%, represents a case that requires the largest number of cockles Mx.

Past experiments found that when the interval R between electrodes is set to 2 mm and the amount of cockling is suppressed below 0.2 mm, the length Q along the bulge of the recording sheet 6 is about 2.04 mm.

Substituting these values into Equation (4) results in $$\frac{La}{Q-R} = \frac{0.01}{2.04-2} = \frac{1}{4}L = Mx \tag{5}$$

Equation (5) represents the condition that requires the greatest number of cocklings.

Next, a case requiring the smallest number Mx of cockles is when the recording sheet 6 used is one that exhibits almost no swelling when struck with ink, such as an OHP sheet. In this case, there is no problem if the number of cockles Mx is zero.

As long as the amount of cockling Z produced does not have detrimental effects on recording, there is no need to increase the number of electrodes X more than required. It is desired that the width 1 of each electrode be set as large as possible to provide large attraction areas. In the case of an OHP sheet, for example, the sheet need only be held to the electrodes, so that only one positive/negative electrode may be used to hold the sheet by the entire electrode surface.

From the above analysis result, it is seen that to determine the number of cockles Mx, the relationship given by Equations (5), (6) and (7) must hold between the number of electrodes X and the length L:

$$Mx \leqq \frac{1}{4} L \tag{6}$$

$$X \leqq \frac{1}{4} L \tag{7}$$

where L is an absolute value in millimeters of the dimension of the attracted area of the sheet as measured in the direction of electrode arrangement.

When the attraction force of the electrode which is ground becomes weak, or when the mounting part of the recording medium caused by the cockling is formed on the electrode which is ground, it is necessary that the number of electrodes X is two times as many as that of cockles Mx. Therefore, in order to determine the number of electrodes X, the relationship given by Equation (8) must hold between the number of electrodes X and the length L:

$$X \leqq \frac{1}{2} L \tag{8}$$

The number of electrodes X, the length L of the recording medium, the minimum distance α between the recording medium and the ink jet recording head, and the height Z of deformation of the recording medium satisfy as preferred conditions the following relationship:

$$\frac{1}{80} \frac{L}{(Y-\alpha)} \leqq X \leqq \frac{1}{20} \frac{L}{(Y-\alpha)} \tag{9}$$

where Z<Y; Y is the distance between the recording medium and the recording head.

The lower limit in the equation (9) designates a ratio of present of stronger electrostatic attraction regions which can uniformly distribute the cockling on the recording medium. To satisfy the lower limit, it is found that it is preferable to obtain good quality of the image and good feel of the recording medium with the image thereon. In the present invention, the upper limit in the equation (9) is not determined concretely, and the scope of the invention does not include a conventional stronger attraction region which is operated on the whole surface of the recording medium to be recorded. The reasonable upper limit above in the equation (9) can be obtained to attain the transportability and cost when using an ink jet recording apparatus having a mechanism which is capable to intermittently transport and stop the recording medium. The lower and upper limits of the equation (9) are useful to perform the ink jet recording.

In the equation (9), the height Z of deformation of the recording medium is equal to Y−α. When the height Z must be controlled to be small, it is necessary to equip a lot of number of the electrodes. When the height Z may be large, the number of electrodes X may be small.

Further, when one of the pair of the electrodes is grounded not to generate electrostatic attraction force, the number of electrodes are at least two times as many as that of electrodes which each generate electrostatic attraction force. In this case, the following relationship is necessary:

$$\frac{1}{40} \frac{L}{(Y-\alpha)} \leqq X \leqq \frac{1}{10} \frac{L}{(Y-\alpha)} \tag{10}$$

(Embodiment 5)

Figure 10:
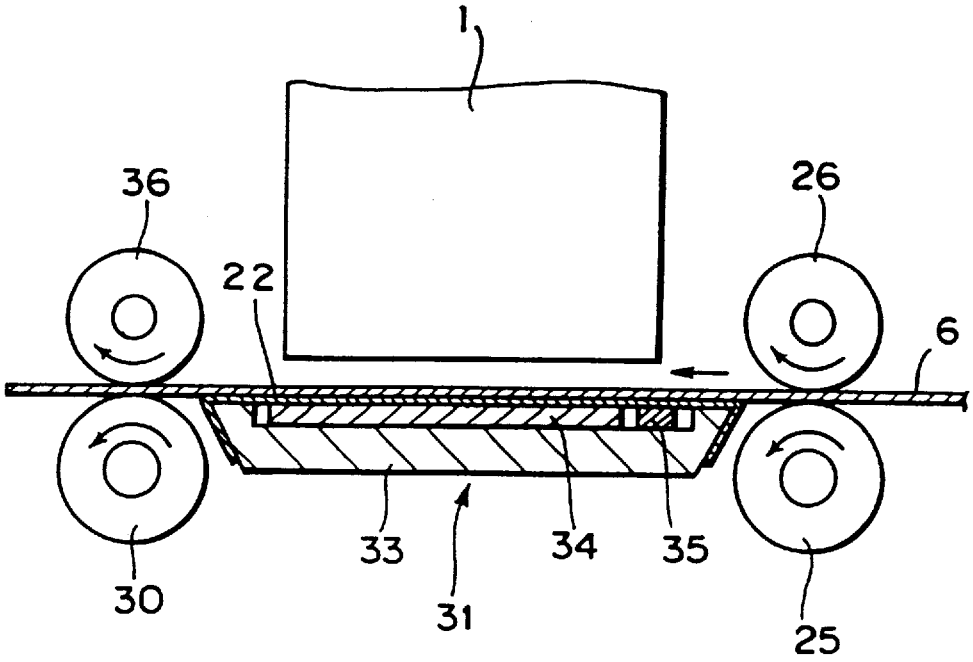
FIG. 10 is a schematic cross sectional view showing a fifth embodiment of the ink jet recording apparatus of the present invention.

FIG. 10 is a schematic cross section showing the fifth embodiment of the ink jet recording apparatus of the present invention. The preceding fourth embodiment is an example application, to the ink jet recording apparatus, of a construction in which the recording sheet 6 is fed along the sheet holding member 28 formed of an endless belt. The fifth embodiment represents an example application of a construction in which two roller pairs 26, 25/36, 30 are arranged on the upstream and downstream side of the recording head 1 with respect to the direction of sheet feeding and in which the recording sheet 6 is held between the roller pairs and fed.

In this embodiment, an attraction force generating means 31 to attract the recording sheet 6 is arranged along the sheet feeding path between the upstream roller pair 26, 25 and the downstream roller pair 36, 30.

The basic configuration and working of the attraction force generating means 31 is the same as those of the fourth embodiment and their explanation is omitted.

(Embodiment 6)

Figure 11:
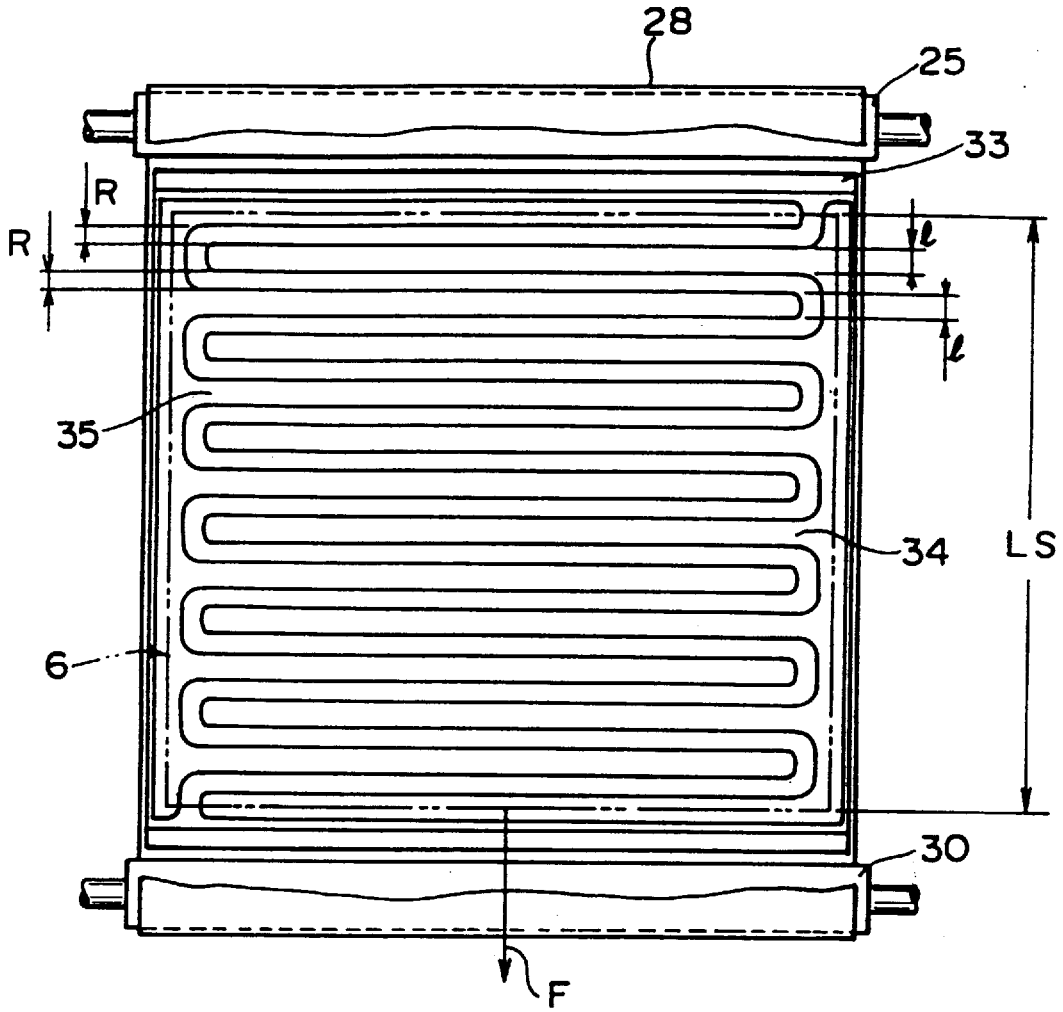
FIG. 11 is a schematic plan view showing a sixth embodiment of the ink jet recording apparatus of the present invention.

FIG. 11 is a schematic plan view showing the sixth embodiment of the ink jet recording apparatus of the invention. In the fourth and fifth embodiments, the sheet feeding direction is perpendicular to the alignment direction of teeth of the comb-shaped electrode plates 34 and 35 provided in the attraction force generation means 31. This embodiment has the electrode teeth alignment directed parallel to the direction of sheet feed, that is, in the case of the serial type shown in FIG. 6, the electrode teeth are set parallel to the scan direction of the recording head 1. In this case, the recording sheet 6 need only be restricted in its elongation of the length LS (mm) in the direction of sheet feed. With this embodiment therefore, the number of teeth (number of electrodes) X and the interval between the teeth R need to be set in a way similar to the preceding embodiments.

In more concrete terms, the number of electrodes X should satisfy the following relationship:

$$\frac{1}{80} \frac{L}{(Y-\alpha)} \leqq X \leqq \frac{1}{20} \frac{L}{(Y-\alpha)} \tag{11}$$

where a minimum distance α is between the recording medium and the ink jet recording head.

When one of the pair of the electrodes is ground not to generate electrostatic attraction force, the following relationship is necessary:

$$\frac{1}{40} \frac{L}{(Y-\alpha)} \leqq X \leqq \frac{1}{10} \frac{L}{(Y-\alpha)} \tag{12}$$

The applied voltage is preferably in the range of 2 to 3 kV.

Other aspects of this embodiment are the same as those of the preceding embodiments of FIGS. 6 to 9, and their explanation is omitted.

(Embodiment 7)

Figure 12:
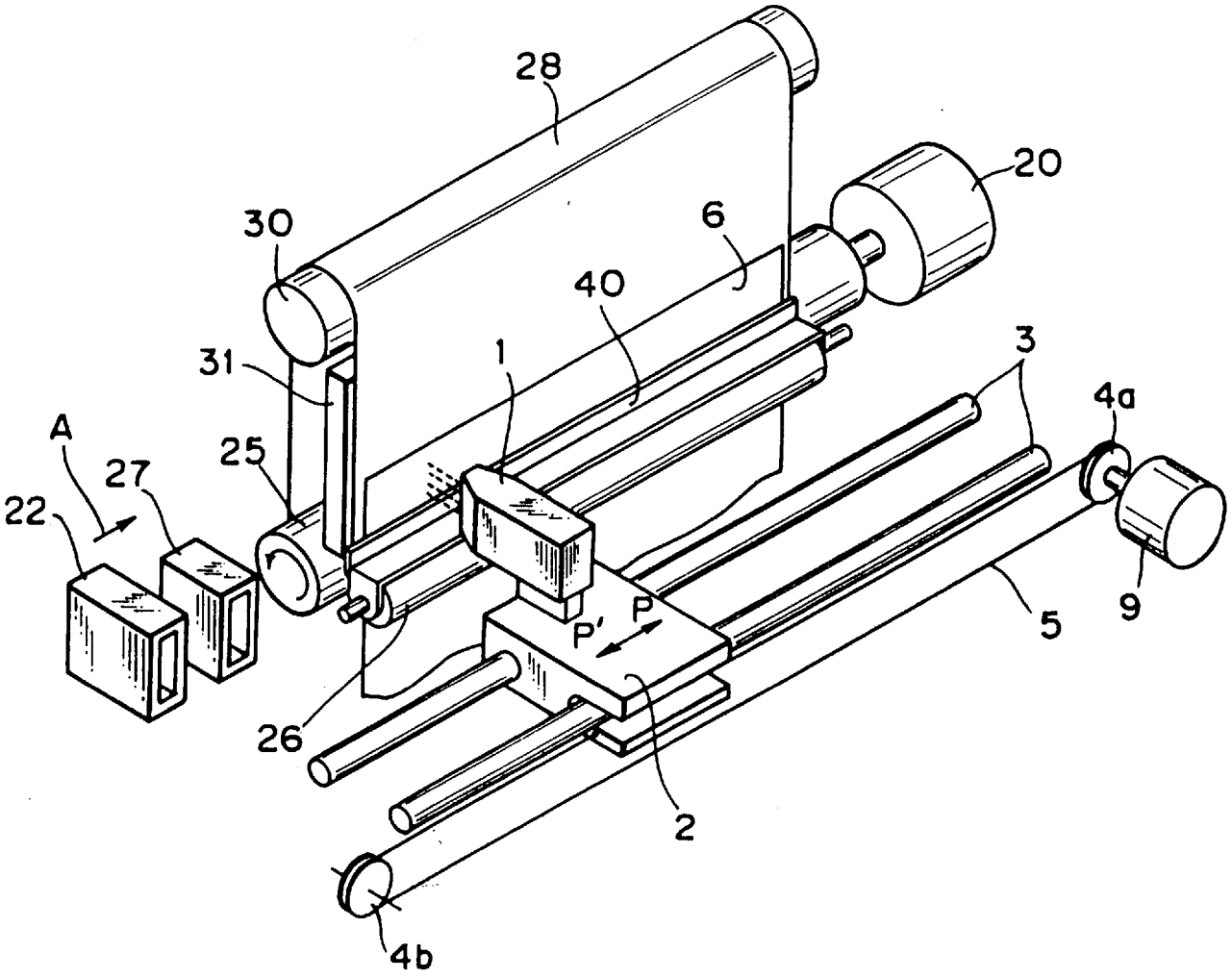
FIG. 12 is a schematic perspective view showing a seventh embodiment of the ink jet recording apparatus of the present invention.

FIG. 12 is a schematic perspective view showing the seventh embodiment of the ink jet recording apparatus of the present invention. Components identical with those of the fourth embodiment shown in FIG. 6 are assigned like reference numerals and their explanation omitted.

This embodiment is characterized in that a sheet retaining member 40 described later is added to the construction of the preceding fourth embodiment and that a dielectric 41 is embedded between the electrode plates in the attraction force generating means 31. The electrostatic attraction force generated where the dielectric 41 is installed is relatively weak compared with the electrostatic attraction force produced on the electrodes.

The sheet retaining member 40, which works as a recording medium pressing means that presses the recording medium 6 against the transport belt, is mounted in such a way that it is rotatable about the rotating axis of the press roller 26. The sheet retaining member 40 is urged toward the transport belt 28 by an urging means not shown. The sheet retaining member 40 is formed of a conductive metal plate.

In addition to the advantages of the fourth embodiment, the recording apparatus of this configuration offers a further advantage that the recording medium 6, held between the press roller 26 and the transport belt 28 for introduction into the recording section, is pressed against the transport belt 28 by the sheet retaining member 40 as it enters the attraction force generating section where the recording medium is efficiently attracted to the plane portion of the transport belt 28 by the attraction force imparted by the attraction force generating means 31.

If ink is discharged in large amounts onto the recording medium 6 generating cockles thereon, the attraction force of the attraction force generating means 31 and the pressing force of the sheet retaining member 40 combine to hold the recording medium 6 to the transport belt 28, preventing the recording medium 6 from floating toward the recording head 1. This eliminates an accidental contact between the recording head 1 and the recording medium 6, assuring stable recording.

Further, even when the ends of the recording medium 6 are waved or curled due to variations in environmental conditions such as temperature and humidity, the recording medium 6 can be pressed against the transport belt 28 by the sheet retaining member 40 to remove curls and waves as it enters the attraction force generating section. This allows the sheet to be stably attracted and held in the recording section.

Figure 13:
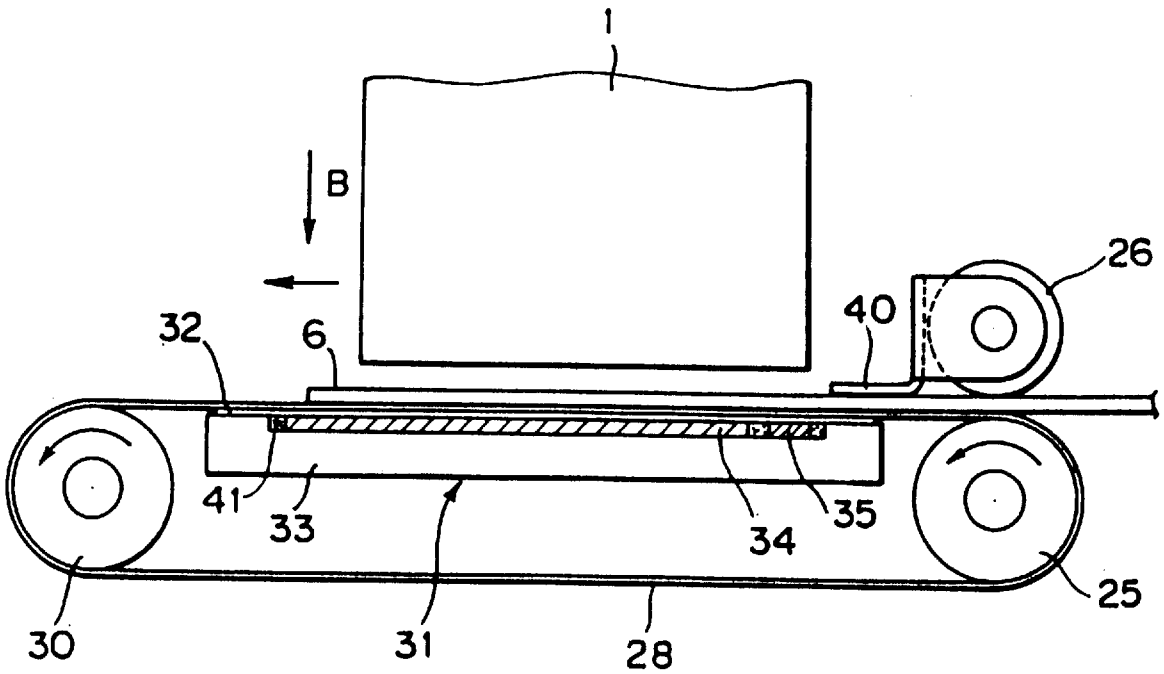
FIG. 13 is a schematic cross sectional view as seen from the arrow A in FIG. 12.
Figure 14:
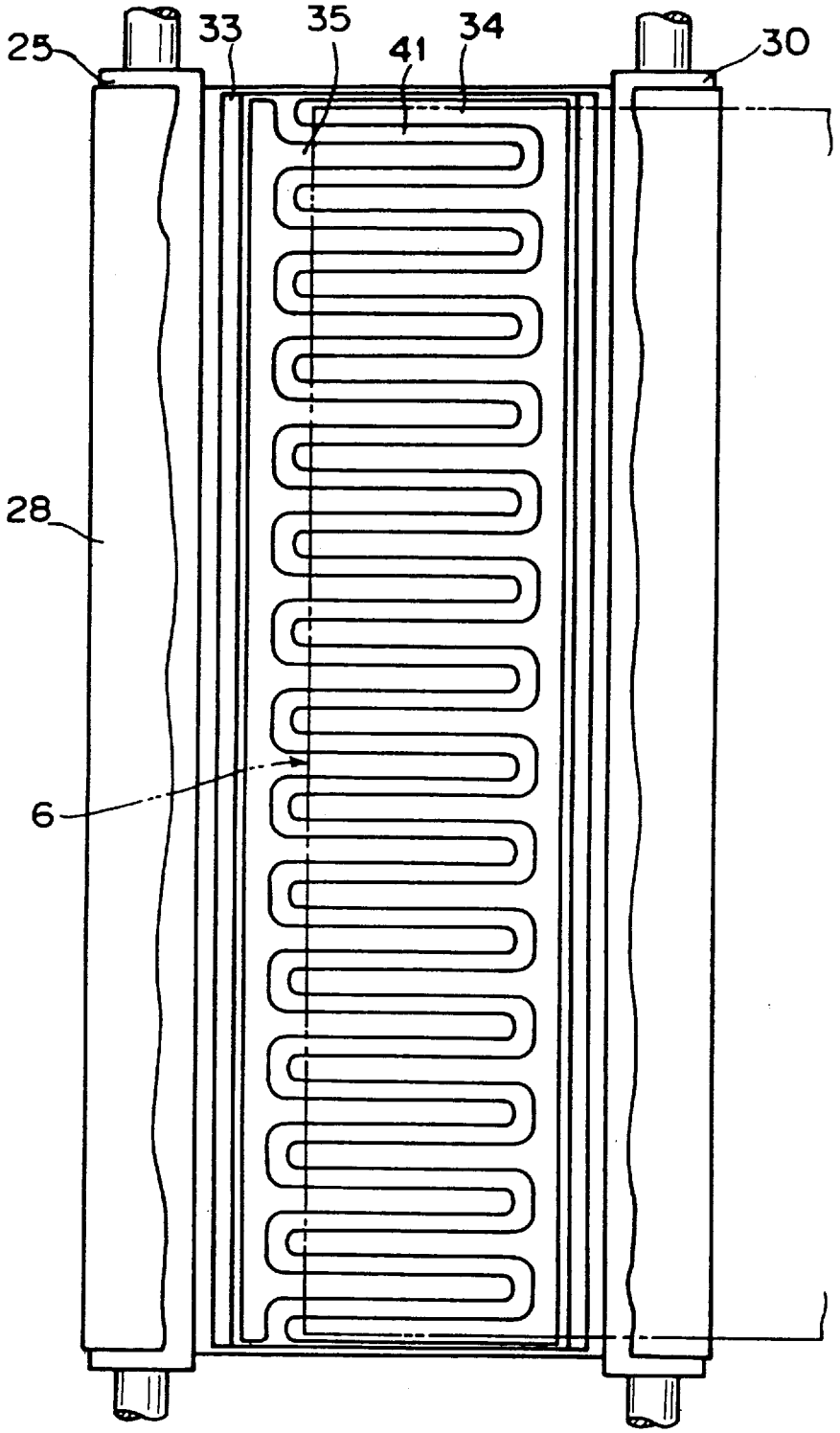
FIG. 14 is a schematic plan view as seen from the arrow B in FIG. 13.

Next, the detail of the attraction force generating means 31 is described by referring to FIGS. 13 and 14.

FIG. 13 is a cross section as seen from the direction of arrow A in FIG. 12. FIG. 14 is a plan view as seen from the direction of arrow B in FIG. 13. In FIG. 13, as in the fourth embodiment of FIG. 7, a protective film 32 is installed below and in contact with the transport belt 28. The protective film 32, like the transport belt 28, is also formed of synthetic resin such as polyethylene and polycarbonate about 0.1–0.2 mm thick. The protective film 32 is securely fixed on the electrode mount 33 as by bonding.

Installed below the protective film 32 are an electrode plate 34 and an earth plate 35, both formed of a conductive metal and in contact with the protective film 32. The electrode plate 34 and the earth plate 35 are fixed to the electrode mount 33 as by bonding. The electrode plate 34 and earth plate 35, as shown in FIG. 14, are comb-shaped and arranged so that the protruding portions of the electrode plate or earth plate are received in the recessed portions of the earth plate or electrode plate. The electrode plate 34 is applied a positive or negative voltage and the earth plate 35 is grounded. In a space between the electrode plate 34 and the earth plate 35 is embedded a dielectric. 41 that enhances the efficiency of the attraction force generating means 31 attracting the recording medium 6.

When a voltage is applied to the electrode plate 34, an electrostatic attraction force is generated in the transport belt 28 through the protective film 32 and an electric charge (surface potential) of the same polarity as the voltage applied to the electrode plate 34 is produced on the recording surface of the recording medium 6. At this time, the conductive sheet retaining member 40 is either grounded or applied a voltage of the reverse polarity to the voltage applied to the electrode plate 34, i.e. a voltage of the reverse polarity to the electric charge generated on the recording surface of the recording medium 6 to eliminate the charges on the recording surface (surface potential) thereby protecting the recording process against being adversely affected by electric charges. In this way, a stable recording is performed.

(Embodiment 8)

Figure 15:
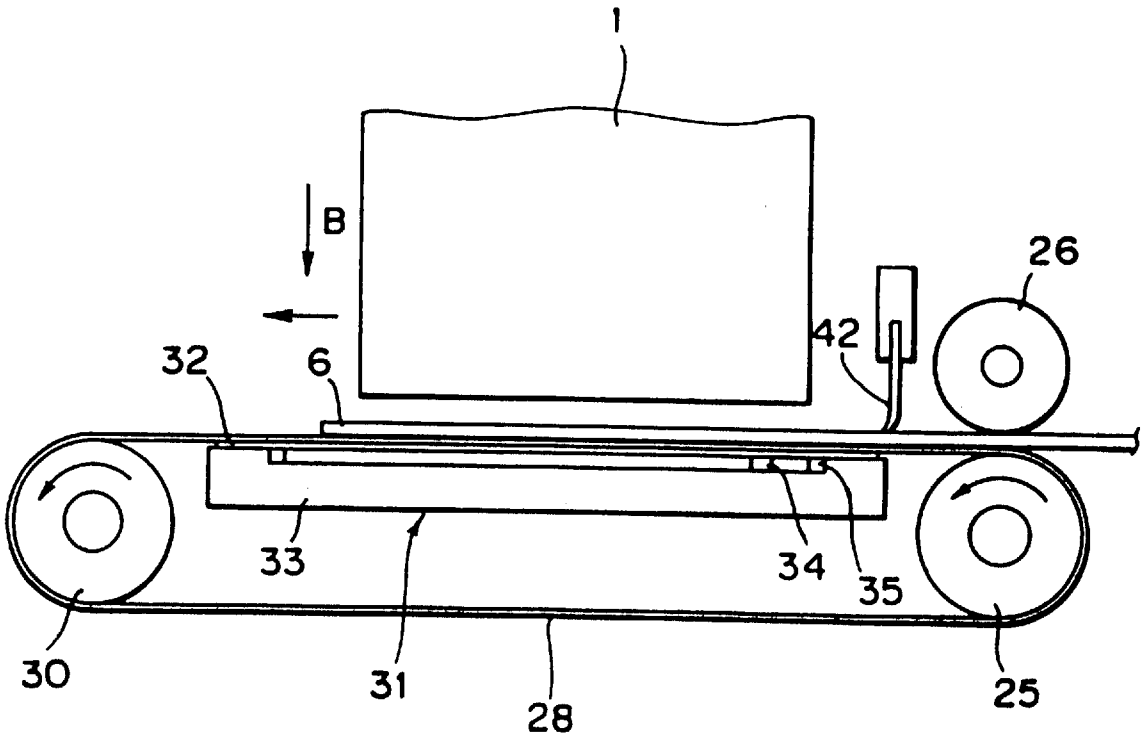
FIG. 15 is a schematic cross sectional view showing an eighth embodiment of the ink jet recording apparatus of the present invention.

FIG. 15 is a cross section showing the eighth embodiment of the ink jet recording apparatus of the present invention.

While, in the preceding seventh embodiment, the recording medium retaining means 40 is formed of a conductive metal plate, it is possible to use as a sheet retaining member a charge removing member 42 in the form of a brush made of a conductive metal or bundled resin fibers, as shown in FIG. 15. The brush-shaped charge removing member 42 reliably prevents the recording medium 6 from floating while at the same time efficiently removing static electricity from the surface of the recording medium 6.

Other aspects of the construction of this embodiment are the same as those of the preceding embodiments and therefore their explanation omitted.

(Embodiment 9)

Figure 16:
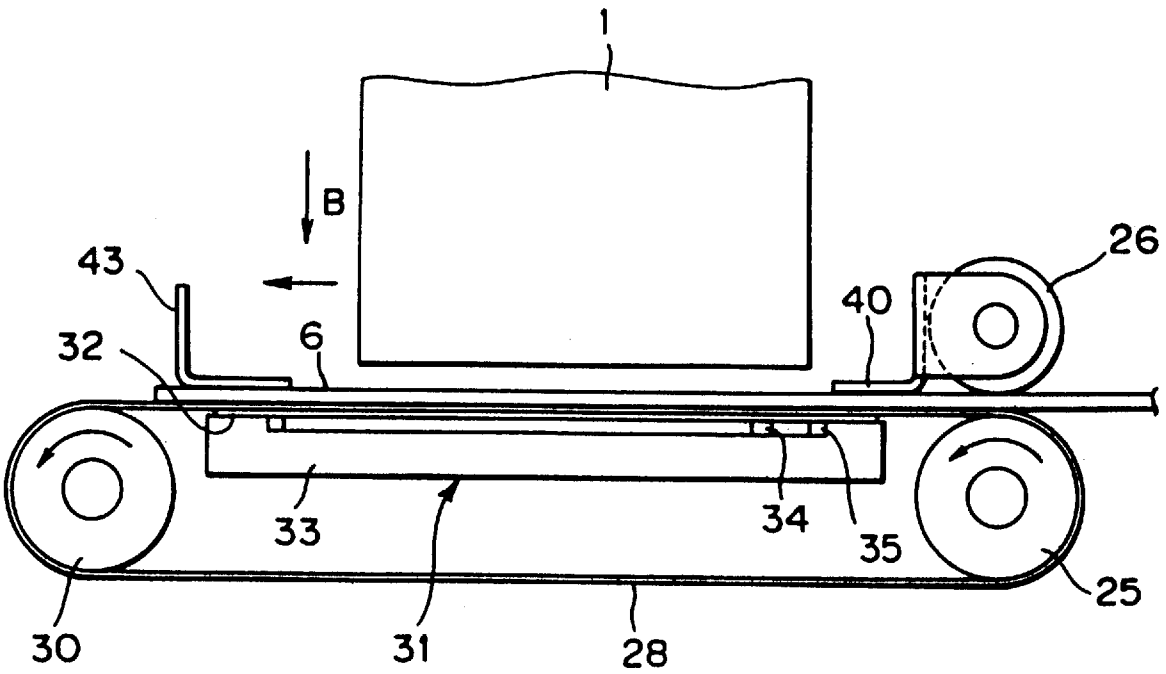
FIG. 16 is a schematic cross sectional view showing a ninth embodiment of the ink jet recording apparatus of the present invention.

FIG. 16 is a cross section showing the ninth embodiment of the ink jet recording apparatus of the present invention.

While the preceding seventh embodiment uses the construction in which the sheet retaining member 40 is installed on the upstream side of the recording region, it is possible to locate a sheet retaining member 43 on the downstream side of the recording region as shown in FIG. 16. It is also possible to arrange it only on the downstream side.

(Embodiment 10)

Figure 17:
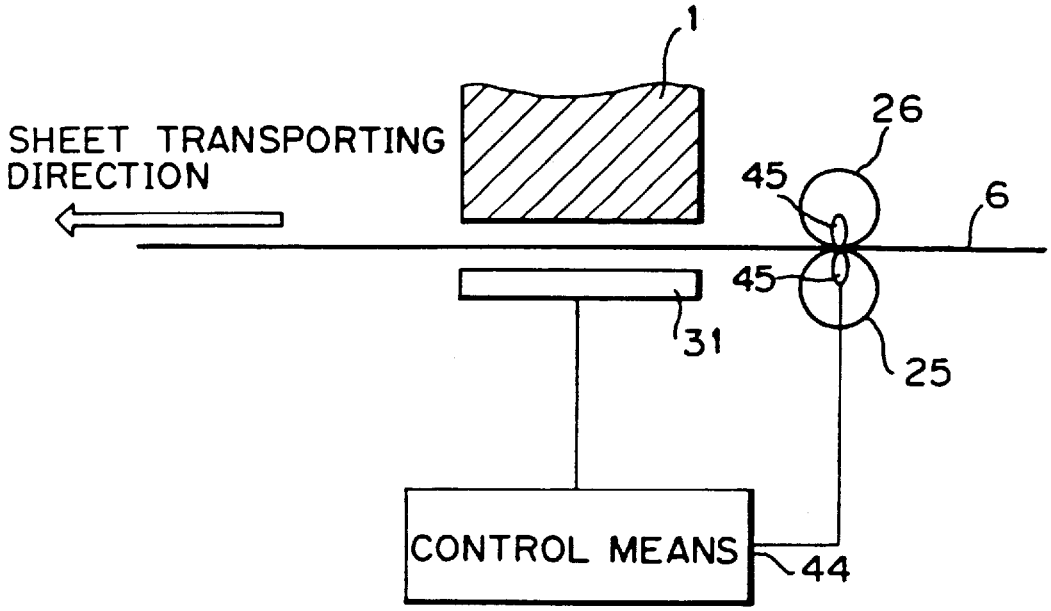
FIG. 17 is a schematic cross sectional view showing a tenth embodiment of the ink jet recording apparatus of the present invention.
Figure 18:
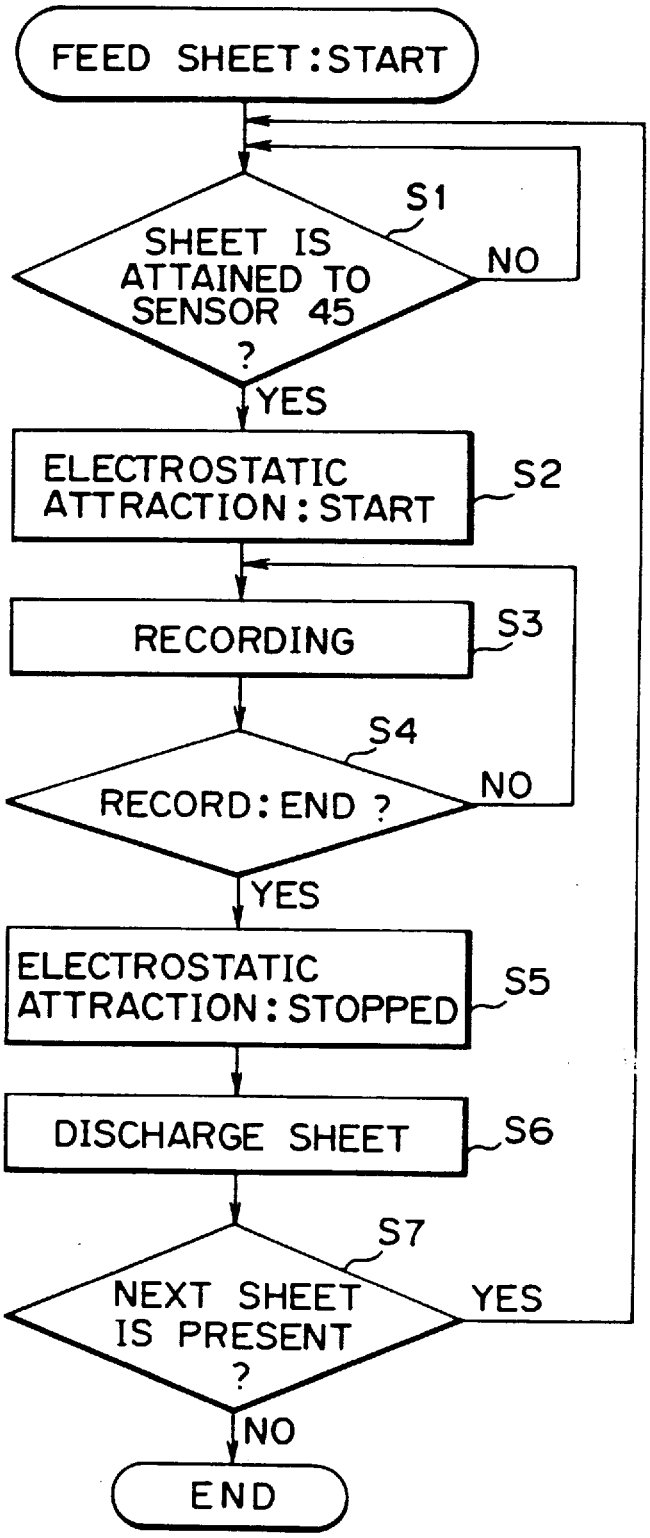
FIG. 18 is a flow chart showing flows of the method of controlling the recording apparatus of FIG. 17.

FIG. 17 is a cross section showing the tenth embodiment of the ink jet recording apparatus of the present invention. FIG. 18 is a flow chart used to explain the method of controlling the recording apparatus shown in FIG. 17.

By referring to FIG. 17 and 18, we will describe the process of controlling the attraction force generating means in connection with the sheet feeding and recording operations in the preceding embodiments.

In FIG. 17, reference number 44 represents a control means to control an on/off operation of the attraction force generating means 31. The control means 44 is connected to a sheet end sensor 45 arranged upstream of the recording region and activates the attraction force generating means 31 when the front end of the recording medium 6 reaches the sheet end sensor 45.

The control procedure is described with reference to FIG. 18.

First, a sheet feeding operation is started to feed the recording medium to a specified position in the recording region. When the recording medium 6 is set up at the sensor 45 (S1), the electrostatic attraction for the recording medium is initiated (S2). Subsequently, when the recording medium 6 is set at a starting position for recording operation, the recording operation is performed (S3).

Next, if the recording on the recording medium 6 by the recording head 1 is still under way, i.e. only several lines have been recorded on one page (S4), the process returns to the previous step S3. When one-sheet recording is finished (S4), the attraction operation by the attraction force generating means 31 is stopped (S5), followed by the recording medium 6 being transported and discharged (S6).

Next, when another recording medium 6 to be recorded is present (S7), the process returns to a point before the step S1. If no recording medium 6 to be recorded is present, the recording is terminated.

With the control performed in this way, it is possible to quickly and reliably set the front end of the recording medium and, during recording, to minimize and distribute the cockles formed.

Further, because the attraction force is reset during discharging, the discharging load can be alleviated.

Although in these embodiments the roller pairs are provided both upstream and downstream of the recording regions and an endless transport belt is wound on these rollers to feed the recording medium, it is possible to use platen rollers in feeding the recording medium and to utilize the rotating force of the platen rollers to efficiently feed the recording medium.

As described above, in the ink jet recording apparatus that ejects ink for recording, the present invention minimizes by the attraction force generating means the recording medium waving phenomenon that occurs when ink is discharged in large amounts and absorbed in the recording medium, thereby preventing contact between the recording medium and the recording head and also their contact caused by the floating of the ends of the recording medium due to the rigidity of the medium itself.

Further, with the present invention, the recording medium attraction means made up of electrodes arranged along the transport means is provided at the back of the recording region of the recording medium, and if X stand for the number of electrodes and L stands for the length of the recording medium as measured in the direction of electrode arrangement, a minimum distance α between the recording medium and the ink jet recording head for height Z of deformation of the recording medium caused by ink recording is determined from the following relation $$\frac{1}{80}\ \frac{L}{(Y-\alpha)} \leqq X \leqq \frac{1}{20}\ \frac{L}{(Y-\alpha)} \tag{13}$$

where L represents an absolute value in millimeter. Therefore, it is possible to minimize the generation of cockles that would otherwise be produced when the ink is driven into the recording medium causing the medium to swell. This in turn allows high-quality recording with the ink nozzles set close to the recording medium and also permits a significant reduction in the blank margin at the ends of the recording medium in the direction of sheet feed, securing a wide recording area on the recording medium.

Further, because the present invention performs recording by holding the recording medium to the transport belt and moving the transport belt, the nozzles at the end of the recording head can be set close to the ends of the recording medium while recording, allowing a significant reduction in the blank margin on the recording medium.

The attraction force generating means and the recording medium retaining means combine to hold the recording medium to the transport belt, which in turn minimizes the so-called cockling phenomenon that occurs when ink is driven into the recording medium causing the medium to swell. Since the construction, in which the recording medium is held to the transport belt, is provided with an attraction force generating means using an electrostatic attraction force and the recording medium retaining means is formed of a conductive member, it is possible to easily remove electric charge if the electrostatic force is used for attraction, thus preventing the electric charge (surface potential) produced on the recording surface from adversely affecting the recording. As a result, stable recording is assured.

Furthermore, the present invention ensures stable recording even when variations in environment (temperature and humidity) have caused waving and curling of the ends of the recording medium.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. An ink jet recording apparatus using an ink jet recording head, said apparatus comprising:

an ink recording region being located at a position spaced from a position where the ink jet recording head is retained, said region being where recording is performed on a recording medium by the ink jet recording head;

a belt-shaped member for conveying the recording medium; and electrostatic attraction means for electrostatically attracting the recording medium, said electrostatic attraction means being arranged at a position facing the ink jet recording head through said belt-shaped member, in said ink recording region, said electrostatic attraction means including a plurality of first and second regions, said first and second regions being alternately distributed and being arranged in said ink recording region in a direction which crosses a direction in which the recording medium is conveyed, said first regions electrostatically attracting the recording medium in said ink recording region with a first force, and said second regions attracting the recording medium with a second force weaker than the first force, said first and second regions being fixedly disposed at positions facing the ink jet recording head.

2. An ink jet recording apparatus as claimed in claim 1, wherein said electrostatic attracting means comprises paired comb-shaped electrodes having intervals therebetween, said first regions are where said paired comb-shaped electrodes are provided and the second regions correspond to the intervals between said paired comb-shaped electrodes.

3. An ink jet recording apparatus as claimed in claim 2, wherein said intervals between said paired electrodes are filled with a dielectric.

4. An ink jet recording apparatus as claimed in claim 2, wherein if X stands for the number of the electrodes and L stands for a length of the recording medium to be attracted as measured in a direction of electrode arrangement, a minimum distance α between the recording medium and said ink jet recording head for a height Z of deformation of the recording medium caused by ink recording is determined from the following relationship:

$$\frac{1}{80}\ \frac{L}{(Y-\alpha)} \leqq X \leqq \frac{1}{20}\ \frac{L}{(Y-\alpha)}$$

where Y is a distance between the recording medium when not deformed and the recording head; and Z=Y−α or less.

5. An ink jet recording apparatus as claimed in claim 2, wherein one of each of the paired electrodes is grounded and produces no attraction force, and if X stands for the number of the electrodes and L stands for a length of the recording medium to be attracted as measured in a direction of electrode arrangement, a minimum distance α between the recording medium and the recording head for a height Z of deformation of the recording medium caused by ink recording is determined from the following relationships:

$$\frac{1}{40}\ \frac{L}{(Y-\alpha)} \leqq X \leqq \frac{1}{10}\ \frac{L}{(Y-\alpha)}$$

where Y is a distance between the recording medium when not deformed and the recording head; and Z=Y−α or less.

6. An ink jet recording apparatus as claimed in claim 1, wherein said belt-shaped member is spaced from the ink jet recording head, and is disposed over said first and second regions.

7. An ink jet recording apparatus as claimed in claim 6, wherein said electrostatic attraction means comprises electrodes arranged so that edges of the recording medium along a direction in which said belt-shaped member conveys the recording medium move over said electrodes.

8. An ink jet recording apparatus as claimed in claim 6, further comprising a carriage which is movable in a direction perpendicular to the direction in which said belt-shaped member conveys the recording medium and an ink tank storing ink to be supplied to said ink jet recording head, said ink tank and said ink jet recording head form a recording head cartridge, said recording head cartridge being removably mounted on said carriage.

9. An ink jet recording apparatus as claimed in claim 6, further comprising a recording medium retaining means pressing the recording medium against said belt-shaped member, said recording medium retaining means being provided at least near an upstream side of said ink recording region with respect to a transport direction of said belt-shaped member in a recording medium transport path defined by said belt-shaped member.

10. An ink jet recording apparatus as claimed in claim 9, wherein said recording medium retaining means is further provided near a downstream side of said recording region with respect to the transport direction.

11. An ink jet recording apparatus as claimed in claim 10, wherein said recording medium retaining means contacts a recording medium, at least the contacting portion of said recording medium retaining means being formed of an electroconductive material.

12. An ink jet recording apparatus as claimed in claim 9, wherein said recording medium retaining means contacts a recording medium, at least the contacting portion of said recording medium retaining means being formed of an electroconductive material.

13. A method of ink jet recording, said method comprising the steps of:

providing an ink jet recording apparatus using an ink jet recording head, said apparatus including an ink jet recording region being located at a position spaced from a position where said ink jet recording head is retained, said region being where recording is performed on a recording medium by said ink jet recording head, a belt-shaped member for conveying the recording medium, and electrostatic attraction means for electrostatically attracting the recording medium, said electrostatic attraction means being arranged at a position facing the ink jet recording head through said belt-shaped member, in said ink recording region, said electrostatic attraction means including a plurality of first and second regions, said first and second regions being alternately distributed and being arranged in said ink recording region in a direction which crosses a direction in which the recording medium is conveyed, said first regions electrostatically attracting the recording medium in said ink recording region with a first force, and said second regions attracting the recording medium with a second force weaker than the first force, said first and second regions being fixedly disposed at positions facing the ink jet recording head; and performing ink recording by using the electrostatic attraction means to distribute a concentration of cockling which is formed in the recording medium by the ink recording.

14. A method as claimed in claim 13, wherein said electrostatic attracting means comprises paired comb-shaped electrodes having intervals therebetween, said first regions are where said paired comb-shaped electrodes are provided and the second regions correspond to the intervals between said paired comb-shaped electrodes.

15. A method as claimed in claim 14, wherein said intervals between said paired electrodes are filled with a dielectric.

16. A method as claimed in claim 13, wherein said belt-shaped member is spaced from the ink jet recording head, and is dispensed over said first and second regions.

17. A method as claimed in claim 16, wherein said electrostatic attraction means comprises electrodes arranged so that edges of the recording medium, which are along a direction in which said belt-shaped member conveys the recording medium, move over said electrodes.

18. A method for liquid ink recording, said method comprising the steps of:

providing a liquid ink recording apparatus having a liquid ink jet recording head and a plurality of attraction regions for electrostatically attracting portions of a recording medium;

performing liquid ink recording with the liquid ink jet recording head; and actuating the plurality of attraction regions of the apparatus to distribute a concentration of cockling which is formed on the recording medium in said liquid ink recording step, wherein the plurality of attraction regions are arranged in a direction which crosses a direction in which the recording medium is conveyed, wherein a pitch as a distance between respective attraction regions is determined so that a height of the cockling of the recording medium is less than a predetermined height, and wherein if X stands for a number of electrodes in the plurality of attraction regions and L stands for a length of the recording medium to be attracted as measured in a direction of electrode arrangement, a minimum distance α between the recording medium and the liquid ink jet recording head for a height Z of deformation of the recording medium caused by the liquid ink recording is determined from the following relationships:

$$\frac{1}{80}\ \frac{L}{(Y-\alpha)} \leqq X \leqq \frac{1}{20}\ \frac{L}{(Y-\alpha)}$$

where Y is a distance between the recording medium when not deformed and the liquid ink jet recording head; and Z=Y−α or less.

19. A method as claimed in claim 18, wherein the electrodes are paired and one of each pair of electrodes is grounded and produces no attraction force, and the minimum distance α between the recording medium and the liquid ink jet recording head for the height Z of deformation of the recording medium caused by the liquid ink recording is determined from the following relationships:

$$\frac{1}{40}\ \frac{L}{(Y-\alpha)} \leqq X \leqq \frac{1}{10}\ \frac{L}{(Y-\alpha)}$$

where Y is a distance between the recording medium when not deformed and the recording head; and Z=Y−α or less.

20. An ink jet recording apparatus using an ink jet recording head, said apparatus comprising:

an ink recording region located at a position spaced from a position where the ink jet recording head is retained, said region being where recording is performed on a recording medium by the ink jet recording head;

a belt-shaped member for conveying the recording medium; and electrostatic attraction means for electrostatically attracting the recording medium, said electrostatic attraction means being arranged at a position facing the ink jet recording head through said belt-shaped member, in said ink recording region, said electrostatic attraction means including a plurality of first and second regions, said first and second regions being alternately distributed and being arranged in said ink recording region in a direction which crosses a direction in which the recording medium is conveyed, said first regions electrostatically attracting the recording medium in said ink recording region with a first force, and said second regions attracting the recording medium with a second force weaker than the first force, said first and second regions being fixedly disposed at positions facing the ink jet recording head, wherein if X stands for a number of electrodes in said electrostatic attraction means and L stands for a length of the recording medium to be attracted as measured in a direction of electrode arrangement, a minimum distance α between the recording medium and the ink jet recording head for a height Z of deformation of the recording medium caused by ink recording is determined from the following relationships:

$$\frac{1}{80}\ \frac{L}{(Y-\alpha)} \leqq X \leqq \frac{1}{20}\ \frac{L}{(Y-\alpha)}$$

where Y is a distance between the recording medium when not deformed and the recording head; and Z=Y−α or less.

21. A method of ink jet recording, said method comprising the steps of:

providing an ink jet recording apparatus using an ink jet recording head, said apparatus including an ink jet recording region being located at a position spaced from a position where said ink jet recording head is retained, said region being where recording is performed on a recording medium by said ink jet recording head, a belt-shaped member for conveying the recording medium, and electrostatic attraction means for electrostatically attracting the recording medium, said electrostatic attraction means being arranged at a position facing the ink jet recording head through said belt-shaped member, in said ink recording region, said electrostatic attraction means including a plurality of first and second regions, said first and second regions being alternately distributed and being arranged in said ink recording region in a direction which crosses a direction in which the recording medium is conveyed, said first regions electrostatically attracting the recording medium in said ink jet recording region with a first force, and said second regions attracting the recording medium with a second force weaker than the first force, said first and second regions being fixedly disposed at positions facing the ink jet recording head; and performing ink recording by using the electrostatic attraction means to distribute a concentration of cockling which is formed in the recording medium by the ink recording, wherein if X stands for a number of electrodes of said electrostatic attraction means and L stands for a length of the recording medium to be attracted as measured in a direction of electrode arrangement, a minimum distance α between the recording medium and the ink jet recording head for a height Z of deformation of the recording medium caused by ink recording is determined from the following relationships:

$$\frac{1}{80}\ \frac{L}{(Y-\alpha)} \leqq X \leqq \frac{1}{20}\ \frac{L}{(Y-\alpha)}$$

where Y is a distance between the recording medium when not deformed and the recording head; and Z=Y−α or less.

* * * * *

UNITED STATES PATENT AND TRADEMARK OFFICE

CERTIFICATE OF CORRECTION

PATENT NO. : 5,821,968 Page 1 of 2

DATED : October 13, 1998

INVENTOR(S) : OHYAMA ET AL.

It is certified that error appears in the above-identified patent and that said Letters Patent is hereby corrected as shown below:

On the title page, item:

[57] ABSTRACT:

Line 4, "attraction" should read --attraction device--.

Line 6, "The has" should read --The device has--.

Line 11, "attraction" should read --attraction device--.

Line 12, "that" should be deleted.

COLUMN 2:

Line 4, "produces" should read --producing--.

Line 28, "forgoing" should read --foregoing--.

COLUMN 5:

Line 47, "shown of" should read --shown in--.

COLUMN 14:

Line 9, "omitted." should read --has been omitted.--.

UNITED STATES PATENT AND TRADEMARK OFFICE

CERTIFICATE OF CORRECTION

PATENT NO. : 5,821,968 Page 2 of 2

DATED : October 13, 1998

INVENTOR(S) : OHYAMA ET AL.

It is certified that error appears in the above-identified patent and that said Letters Patent is hereby corrected as shown below:

COLUMN 15:

Line 13, "stand" should read --stands--.

Line 22, "millimeter." should read --millimeters.--.

COLUMN 18:

Line 3, "dispensed" should read --disposed--.

Signed and Sealed this

Seventh Day of September, 1999

*Attest:*

Q. TODD DICKINSON

*Attesting Officer*

*Acting Commissioner of Patents and Trademarks*